US011044941B2

(12) United States Patent
Jeong

(10) Patent No.: US 11,044,941 B2
(45) Date of Patent: Jun. 29, 2021

(54) HEATER ASSEMBLY FOR CIGARETTE-SHAPED ELECTRONIC CIGARETTE AND CIGARETTE-SHAPED ELECTRONIC CIGARETTE INCLUDING SAME

(71) Applicant: AMOSENSE CO., LTD, Cheonan-si (KR)

(72) Inventor: Sang Dong Jeong, Gimpo-si (KR)

(73) Assignee: AMOSENSE CO., LTD., Cheonan-si (KR)

( * ) Notice: Subject to any disclaimer, the term of this patent is extended or adjusted under 35 U.S.C. 154(b) by 0 days.

(21) Appl. No.: 16/630,696

(22) PCT Filed: Jul. 13, 2018

(86) PCT No.: PCT/KR2018/007944
§ 371 (c)(1),
(2) Date: Jan. 13, 2020

(87) PCT Pub. No.: WO2019/017654
PCT Pub. Date: Jan. 24, 2019

(65) Prior Publication Data

US 2020/0154766 A1 May 21, 2020

(30) Foreign Application Priority Data

Jul. 21, 2017 (KR) ..... 10-2017-0092705

(51) Int. Cl.
*H01R 13/00* (2006.01)
*A24F 40/30* (2020.01)
(Continued)

(52) U.S. Cl.
CPC ..... *A24F 40/30* (2020.01); *A24F 40/46* (2020.01); *A24F 40/57* (2020.01); *A24F 40/95* (2020.01); *H05B 3/46* (2013.01)

(58) Field of Classification Search
CPC ..... A24F 47/00
(Continued)

(56) References Cited

U.S. PATENT DOCUMENTS 9,462,830 B2 10/2016 Liu
10,123,568 B1 * 11/2018 Zhu ..... A24F 47/008
2013/0014772 A1 1/2013 Liu

FOREIGN PATENT DOCUMENTS

KR 100844445 7/2008
KR 101001077 12/2010
(Continued)

OTHER PUBLICATIONS

International Search Report—PCT/KR2018/007944 dated Feb. 20, 2019.

*Primary Examiner* — Phuong K Dinh
(74) *Attorney, Agent, or Firm* — Cantor Colburn LLP

(57) ABSTRACT

Provided is a heater assembly for a cigarette-shaped electronic cigarette. A heater assembly for a cigarette-shaped electronic cigarette includes a smoking vapor generation part including a first heater configured to generate smoking vapor by heating a portion of a cigarette inserted thereinto, and a smoky vapor generation part including a second heater configured to generate a smoky vapor by heating a liquid material when the cigarette is puffed on, wherein the smoky vapor passes through the cigarette by a suction force generated when the cigarette is puffed on and then is inhaled concurrently with the smoking vapor.

11 Claims, 11 Drawing Sheets

(51) Int. Cl.

| | |
|---|---|
| ***A24F 40/46*** | (2020.01) |
| ***A24F 40/95*** | (2020.01) |
| ***A24F 40/57*** | (2020.01) |
| ***H05B 3/46*** | (2006.01) |

(58) Field of Classification Search
USPC ..... 131/328–329
See application file for complete search history.

(56) References Cited

FOREIGN PATENT DOCUMENTS

| | | |
|---|---|---|
| KR | 101265170 | 5/2013 |
| KR | 20170069994 | 6/2017 |

* cited by examiner

HEATER ASSEMBLY FOR CIGARETTE-SHAPED ELECTRONIC CIGARETTE AND CIGARETTE-SHAPED ELECTRONIC CIGARETTE INCLUDING SAME

CROSS REFERENCE TO RELATED APPLICATION

This application is a national phase entry of International Application No. PCT/KR2018/007944, filed on Jul. 13, 2018, which is based upon and claims priority to Korean Patent Applications 10-2017-0092705, filed on Jul. 21, 2017. The entire contents of which are incorporated herein by reference.

TECHNICAL FIELD

The present invention relates to a heater assembly for an electronic cigarette and a cigarette-shaped electronic cigarette including the same, and more particularly, a heater assembly for an electronic cigarette, which allows an abundant amount of vapor to be inhaled and exhaled during smoking, and a cigarette-shaped electronic cigarette including the same.

BACKGROUND ART

Electronic cigarettes include a storage, a heating or vaporizing device, and a battery. The storage stores a processed material or extract of a leaf tobacco including nicotine, a nicotine-free liquid material, or the like.

Such an electronic cigarette may generate an aerosol by heating or vaporizing the material stored in the storage so that a user may inhale the aerosol through an intake of the electronic cigarette.

Accordingly, when the user holds the electronic cigarette with his or her hand and puffs on the electronic cigarette through the intake with a user's mouth, the aerosol generated inside the electronic cigarette may be discharged to the user's mouth through the intake, and the user may have a similar feeling to smoking a general cigarette through the inhalation of the aerosol.

However, the conventional electronic cigarettes use a liquid method in which an undiluted nicotine solution and a liquid are separately purchased and mixed. Accordingly, there is a potential risk of misuse if a user uses the purchased undiluted nicotine solution for other purposes rather than smoking. In an example, there may be a problem such as a bombing that uses an undiluted nicotine solution. For this reason, the undiluted nicotine solution requires active management in handling when using the undiluted nicotine solution.

In order to solve such problems, cigarette-shaped electronic cigarettes, which generate smoking vapor by heating a solid stick made of tobacco leaves unlike the conventional liquid electronic cigarettes, have been proposed. Since such a cigarette-shaped electronic cigarette uses a method of generating vapor by heating a solid stick inserted thereinto using a heater, the cigarette-shaped electronic cigarette may solve a risk of misuse of an undiluted nicotine solution and may taste similar to the conventional cigarette.

However, since the conventional cigarette-shaped electronic cigarette uses a method of simply heating the solid stick, the conventional cigarette-shaped electronic cigarette may not generate an abundant amount of vapor. Accordingly, there is a problem in that a user is less satisfied than when smoking a general tobacco cigarette.

In addition, the conventional cigarette-shaped electronic cigarette uses a method in which a heater for heating a solid stick is implemented in the form of a plate and is partially inserted into the solid stick. Therefore, it is difficult to uniformly heat an entirety of the solid stick.

DISCLOSURE

Technical Problem

The present invention is directed to providing a heater assembly for a cigarette-shaped electronic cigarette, which allows an abundant amount of vapor to be inhaled and exhaled during smoking, and a cigarette-shaped electronic cigarette including the same.

In addition, the present invention is directed to providing a heater assembly for a cigarette-shaped electronic cigarette, which is capable of widening a heated area of a cigarette inserted thereinside and uniformly heating the cigarette, and a cigarette-shaped electronic cigarette including the same.

Technical Solution

According to one exemplary embodiment of the present invention, a heater assembly for a cigarette-shaped electronic cigarette includes a smoking vapor generation part including a first heater configured to generate smoking vapor by heating a portion of a cigarette inserted thereinto, and a smoky vapor generation part including a second heater configured to generate smoky vapor by heating a liquid material when the cigarette is puffed on, wherein the smoky vapor passes through the cigarette by a suction force generated when the cigarette is puffed on and then is inhaled concurrently with the smoking vapor.

The heater assembly may further include a supporting part to which each of the smoking vapor generation part and the smoky vapor generation part is coupled, and the supporting part may include a movement passage through which the smoky vapor generated in the smoky vapor generation part is moved to the smoking vapor generation part.

The supporting part may include a protrusion in a hollow form which protrudes in one direction and to which the smoky vapor generation part is coupled, and a communication passage may be formed in a bottom surface of the protrusion and connected to the movement passage.

The smoky vapor generation part may be detachably coupled to the supporting part.

An accommodation groove may be formed in one surface of the supporting part to accommodate a circuit board, and the circuit board may be electrically connected to the first heater.

The first heater may be formed to have a hollow cylindrical shape of which upper and lower portions are open such that the portion of the cigarette is inserted thereinto, and the first heater may heat an outer surface of the cigarette.

The first heater may include a support made of a ceramic material and formed to have a hollow form, an electrode pattern patterned on one surface of the support to generate heat, and a protective layer having an insulating property and a heat insulating property and covering the electrode pattern.

The smoking vapor generation part may include the first heater, a heat insulating member wound in a circumferential direction of the first heater, and a fixing member configured to surround the heat insulating member to protect the first heater and fix the heat insulating member.

The heat insulating member may include a graphite material to reduce heat generated in the first heater from being dissipated in a radial direction of the first heater.

The smoking vapor generation part may include a first cover member detachably coupled to the supporting part, and a gap may be formed between the first cover member and the fixing member in a radial direction of the first heater.

The smoky vapor generation part may include a body having an air passage formed in a length direction thereof such that outside air passes through the air passage, a coupling member coupled to the body, a second cover member coupled to the coupling member to form a storage space in which the liquid material is accommodated in a certain amount, an absorption member disposed in the air passage to absorb the liquid material introduced from the storage space, and a second heater wound a plurality of times in a length direction of the absorption member to generate the smoky vapor by vaporizing the liquid material absorbed by the absorption member when power is applied.

According to one exemplary embodiment of the present invention, a cigarette-shaped electronic cigarette includes the heater assembly, a case which has an inlet for inserting the cigarette in a region corresponding to the smoking vapor generation part and in which the heater assembly is embedded, a control part disposed inside the case to control an overall operation of the heater assembly, and a power supply part configured to supply driving power to the control part.

The case may include a cover member configured to open or close the inlet.

A charging port configured to recharge power of the power supply part may be provided at one side of the case.

Advantageous Effects

According to the present invention, since smoky vapor is additionally generated through a smoky vapor generation part during smoking, a user can inhale and exhale an abundant amount of vapor, thereby increasing user satisfaction.

In addition, according to the present invention, since a heater has a cylindrical shape, a heated area of a cigarette inserted thereinto can be widened, and the cigarette can be uniformly heated.

MODES OF THE INVENTION

Figure 1:
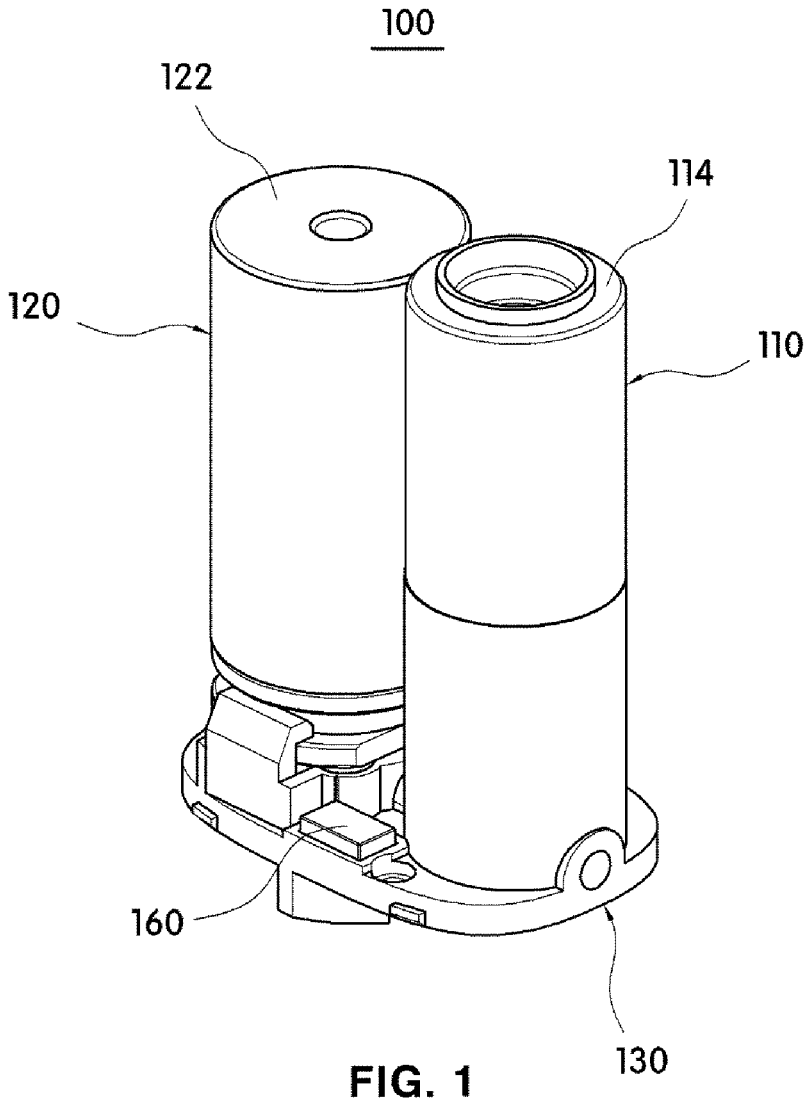
FIG. 1 is a view illustrating a heater assembly for a cigarette-shaped electronic cigarette according to one exemplary embodiment of the present invention.

Hereinafter, exemplary embodiments of the present invention will be described in detail with reference to the accompanying drawings so as to be easily practiced by a person of ordinary skill in the art. It should be understood that the present invention may be embodied in different ways and is not limited to the following exemplary embodiments. Parts irrelevant to description are omitted in the drawings in order to clearly explain the present invention, and like reference numerals refer to like elements throughout the specification.

As shown in FIGS. 10 to 13, a heater assembly 100 for a cigarette-shaped electronic cigarette according to one exemplary embodiment of the present invention may be applied to a cigarette-shaped electronic cigarette 200 which generates smoking vapor by heating a cigarette 10 produced as a solid stick.

Accordingly, the cigarette-shaped electronic cigarette 200, to which the heater assembly 100 for a cigarette-shaped electronic cigarette according to one exemplary embodiment of the present invention is applied, may generate not only smoking vapor including nicotine but also smoky vapor, thereby emitting vapor in an amount that is greater than or equal to an amount of smoke generated during smoking of an actual cigarette.

Figure 2:
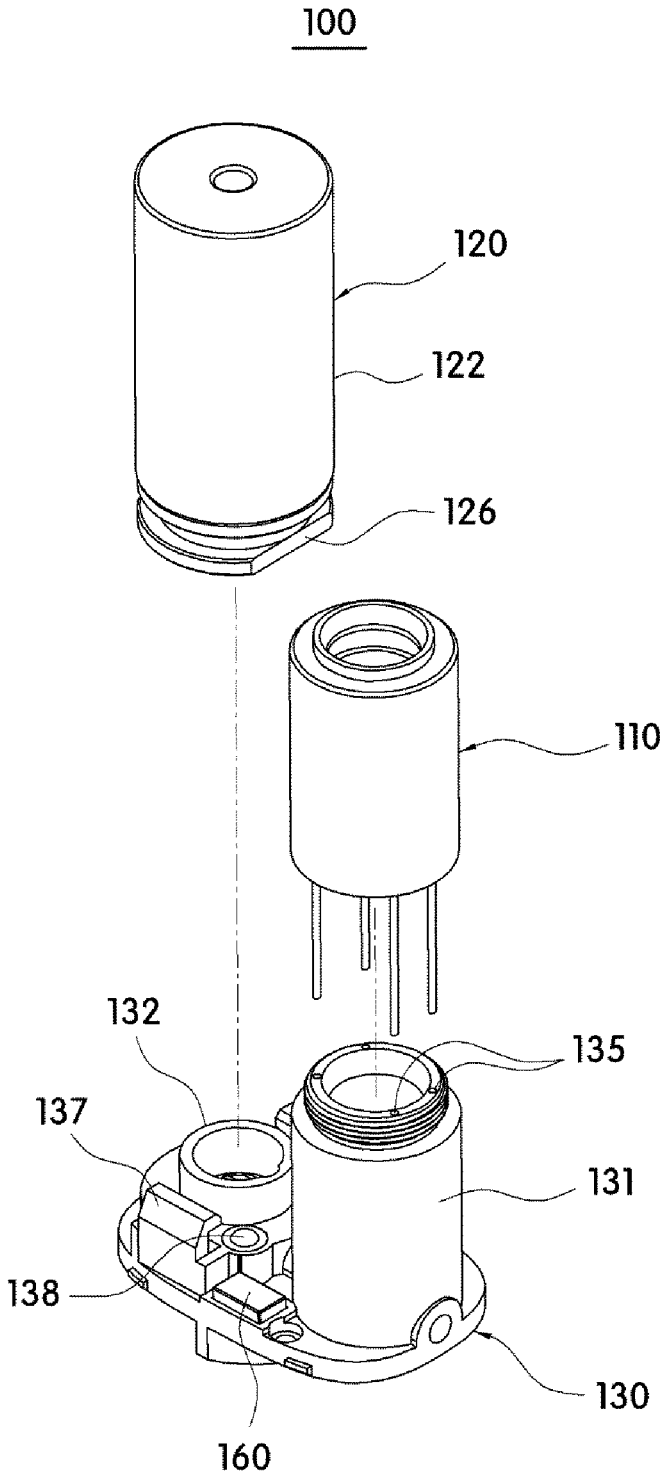
FIG. 2 is a view illustrating a state in which a smoking vapor generation part and a smoky vapor generation part are separated from the heater assembly in FIG. 1.
Figure 3:
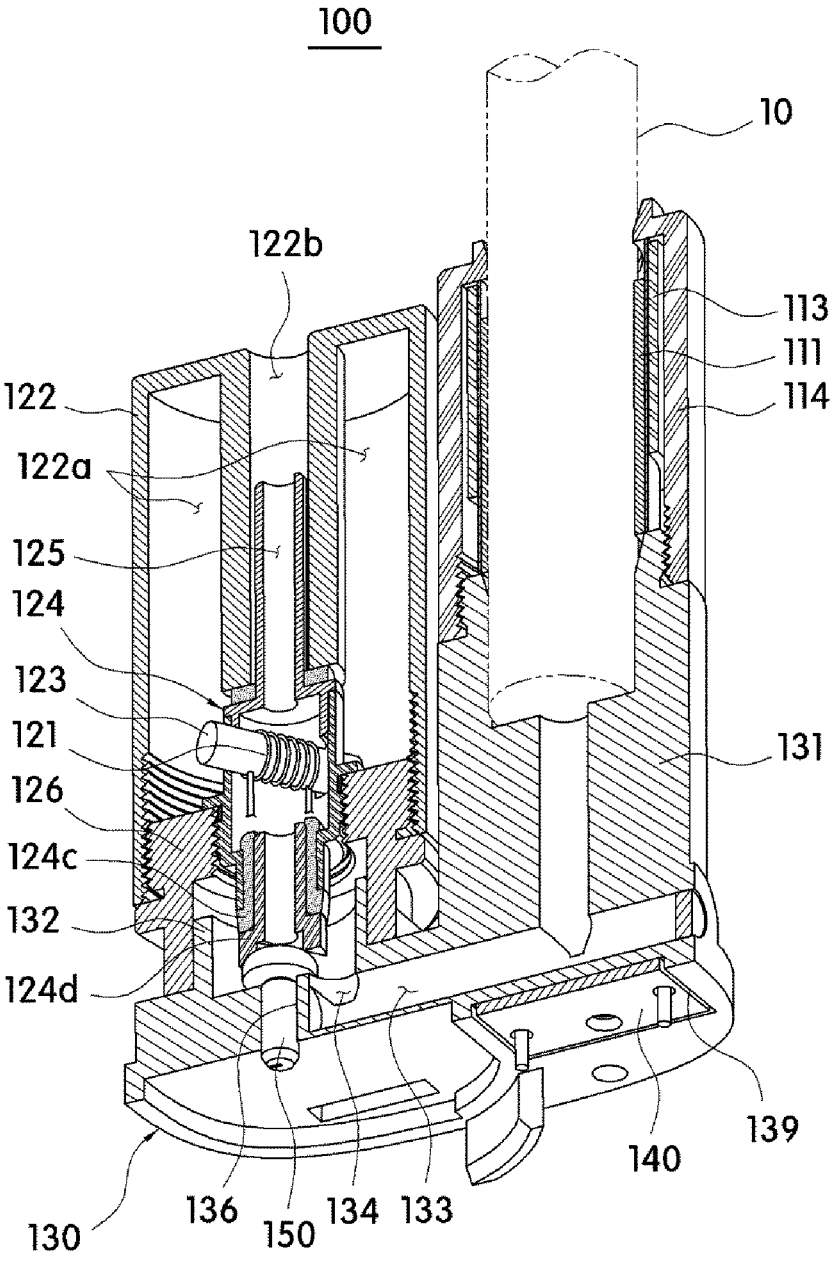
FIG. 3 is a longitudinal sectional view of FIG. 1.

To this end, as shown in FIGS. 1 to 3, the heater assembly 100 for a cigarette-shaped electronic cigarette according to one exemplary embodiment of the present invention includes a smoking vapor generation part 110 and a smoky vapor generation part 120.

During smoking, the smoking vapor generation part 110 may heat the cigarette 10 to generate smoking vapor including nicotine. To this end, the smoking vapor generation part 110 may include a first heater 111 configured to heat the cigarette 10 when power is applied.

Figure 4:
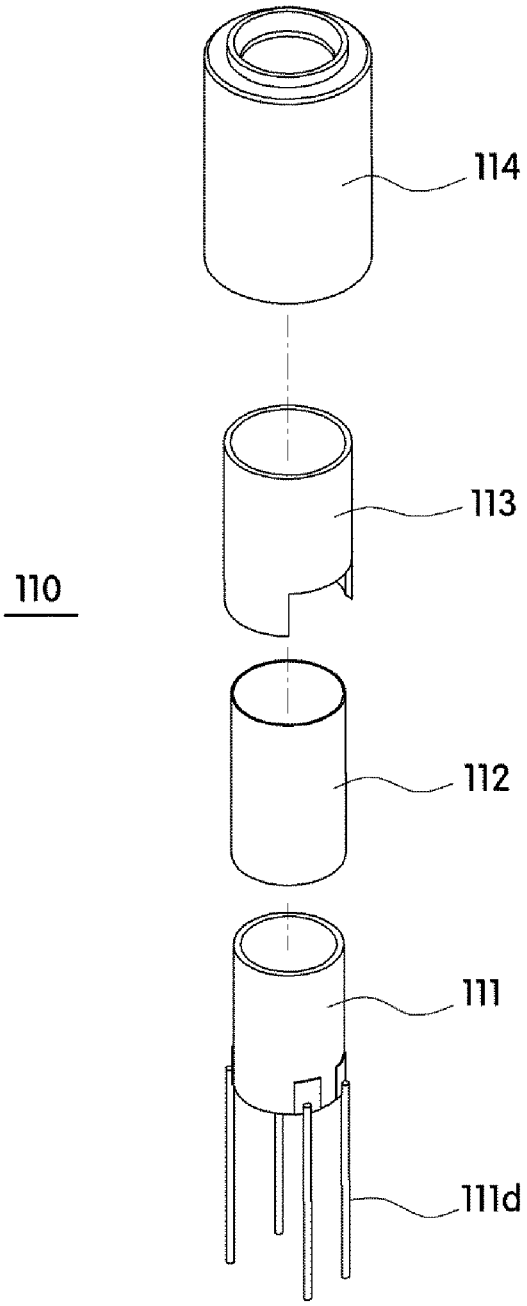
FIG. 4 is an exploded view of a smoking vapor generation part applicable to the heater assembly for a cigarette-shaped electronic cigarette according to one exemplary embodiment of the present invention.
Figure 5:
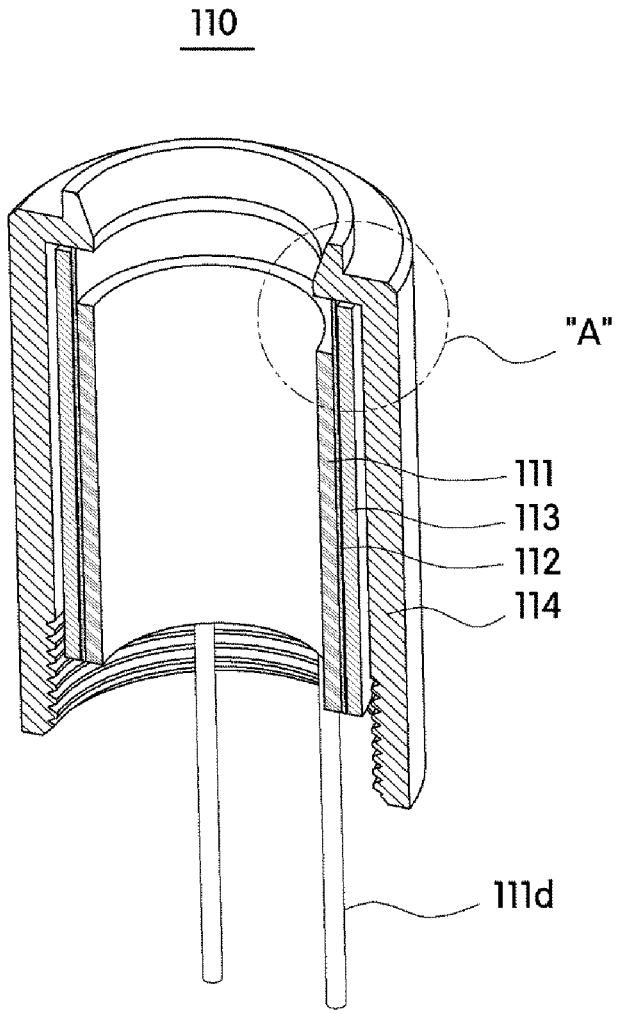
FIG. 5 is a longitudinal sectional view of the smoking vapor generation part applicable to the heater assembly for a cigarette-shaped electronic cigarette according to one exemplary embodiment of the present invention.

In this case, as shown in FIG. 4, the first heater 111 may be formed to have a hollow cylindrical shape of which upper and lower portions are open such that a portion of the cigarette 10 is insertable thereinto.

Accordingly, as shown in FIG. 3, the cigarette 10 inserted into a hollow portion may be heated through heat that is generated and supplied by the first heater 111. Since an entire circumferential surface of the cigarette 10 may be heated, a heated area of the cigarette 10 may be widened, and concurrently, an entirety of the cigarette 10 may be uniformly heated.

The first heater 111 may have a form in which a known heater is formed in a cylindrical shape. Meanwhile, in order to increase reliability and a life cycle of a product and rapidly move heat generated from a heat generating source under operating conditions in which heating and cooling are repeatedly performed, the first heater 111 may include a ceramic material.

Figure 7:
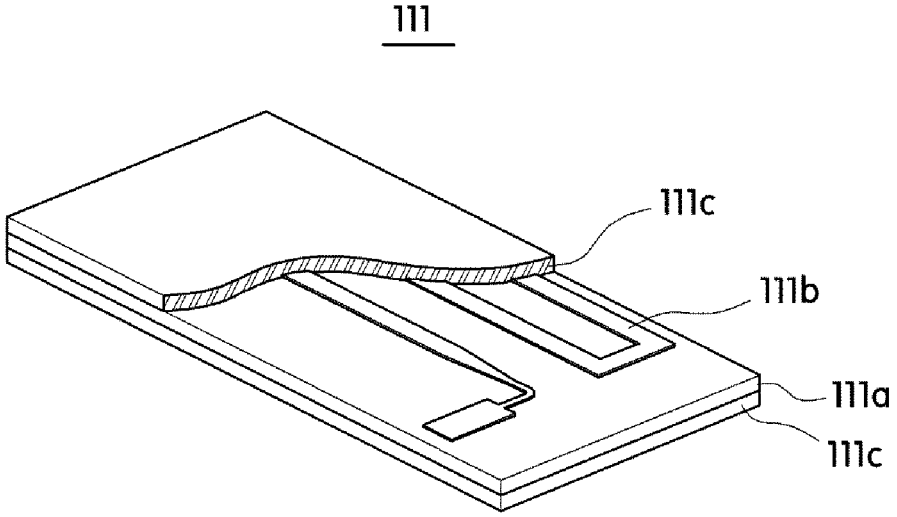
FIG. 7 is a view illustrating a detailed configuration of a first heater applicable to the heater assembly for a cigarette-shaped electronic cigarette according to one exemplary embodiment of the present invention and illustrating a state in which the first heater is forcibly unfolded.

In an example, as shown in FIG. 7, the first heater 111 may include a support 111*a*, an electrode pattern 111*b*, and a protective layer 111*c*.

In this case, the support 111*a* may be made of a ceramic material, and the electrode pattern 111*b* may be patterned and formed on one surface of the support 111*a*.

Accordingly, heat generated in the electrode pattern 111*b* when power is applied may be moved to the support 111*a* made of a ceramic material and then may be rapidly transferred to an entire area of the support 111*a*. Thus, the first heater 111 may widen a heated area and concurrently uniformly heat an entirety of the heated area.

In the present invention, the support 111*a* may be made of a ceramic material having a heat resisting property to withstand a high temperature of 100° C. or more when the electrode pattern 111*b* generates heat. In a specific example, the support 111*a* may be made of a ceramic material such as alumina ($Al_2O_3$), magnesium oxide (MgO), silicon nitride ($Si_3N_4$), silicon carbide (SiC), aluminum nitride (AlN), or the like, but the present invention is not limited thereto. Any known ceramic material may be applied.

However, the material of the support 111*a* is not limited thereto, and any material may be applied as long as the material may have an insulating property and a heat resisting property to prevent a short circuit with the electrode pattern 111*b* and to withstand a high temperature of 100° C. or more when the electrode pattern 111*b* generates heat.

In addition, the electrode pattern 111*b* may serve as a heating element which generates heat when power is applied. The electrode pattern 111*b* may be patterned and formed on one surface of the support 111*a*.

In the present invention, the electrode pattern 111*b* may be a printed pattern formed through a conductive paste or may have a form of a conductive member which is patterned and formed through shape processing such as etching or punching and attached to the support 111*a*. In an example, the conductive paste may be silver (Ag), tungsten, molybdenum, or a mixed component thereof but is not limited thereto. Among typically used electrode materials, any known electrode material may be used that is appropriately selected according to a heat-generating temperature required when power is applied.

On the other hand, the protective layer 111*c* may be made of a material having an insulating property to prevent the electrode pattern 111*b* from being externally exposed and also to prevent the electrode pattern 111*b* from being shorted with other components. In addition, the protective layer 111*c* may also have a heat resisting property and a thermosetting property to be prevented from being destroyed by heat generated from the electrode pattern 111*b*.

In an example, the protective layer 111*c* may be a coating layer which is made of a resin having an insulating property, a thermosetting property, and a heat resisting property and is applied at a certain thickness on at least one surface of the support 111*a*. Accordingly, the electrode pattern 111*b* may be blocked from being externally exposed through the protective layer 111*c*.

In a specific example, the protective layer 111*c* may be a coating layer made of liquid polyimide or polyamideimide, but the present invention is not limited thereto. Any known material may be used as long as the material has an insulating property, a thermosetting property, and a heat resisting property.

In this case, the protective layer 111*c* may be formed only on one surface of the support 111*a* to cover the electrode pattern 111*b* or may also be formed to cover both surfaces of the support 111*a*. Accordingly, even when the support 111*a* is made of a ceramic material having high brittleness, an impact caused by an external force may be absorbed through the protective layer 111*c*, thereby preventing the support 111*a* from being damaged by the external force.

The first heater 111 may be electrically connected to a circuit board 140 to be described below through a plurality of lead portions 111*d*, and thus, the electrical operation thereof may be controlled.

Meanwhile, as shown in FIG. 4, the smoking vapor generation part 110 may further include a heat insulating member 112, a fixing member 113, and a first cover member 114. As shown in FIG. 2, the smoking vapor generation part 110 may be detachably coupled to one side of a supporting part 130 through the first cover member 114.

That is, the heat insulating member 112, the fixing member 113, and the first cover member 114 may be sequentially disposed to surround the first heater 111, and the smoking vapor generation part 110 may be maintained in a state of being coupled to the supporting part 130 through the first cover member 114 detachably coupled to the supporting part 130 or may be separated from the supporting part 130.

The heat insulating member 112 may be disposed to surround an outer surface of the first heater 111, thereby blocking heat generated in the first heater 111 from being dissipated to the outside or being transferred to other peripheral components.

Accordingly, heat generated in the first heater 111 may be concentrated in the first heater 111 and may be concentrated to the cigarette 10 inserted into the hollow portion of the first heater 111.

In this case, any heat insulating material that is typically used may be applied to the heat insulating member 112. On the other hand, the heat insulating member 112 may include a graphite material to reduce the heat generated in the first heater 111 being dissipated in a radial direction of the first heater 111 and to facilitate a heat transfer in a horizontal direction perpendicular to the radial direction.

Figure 6:
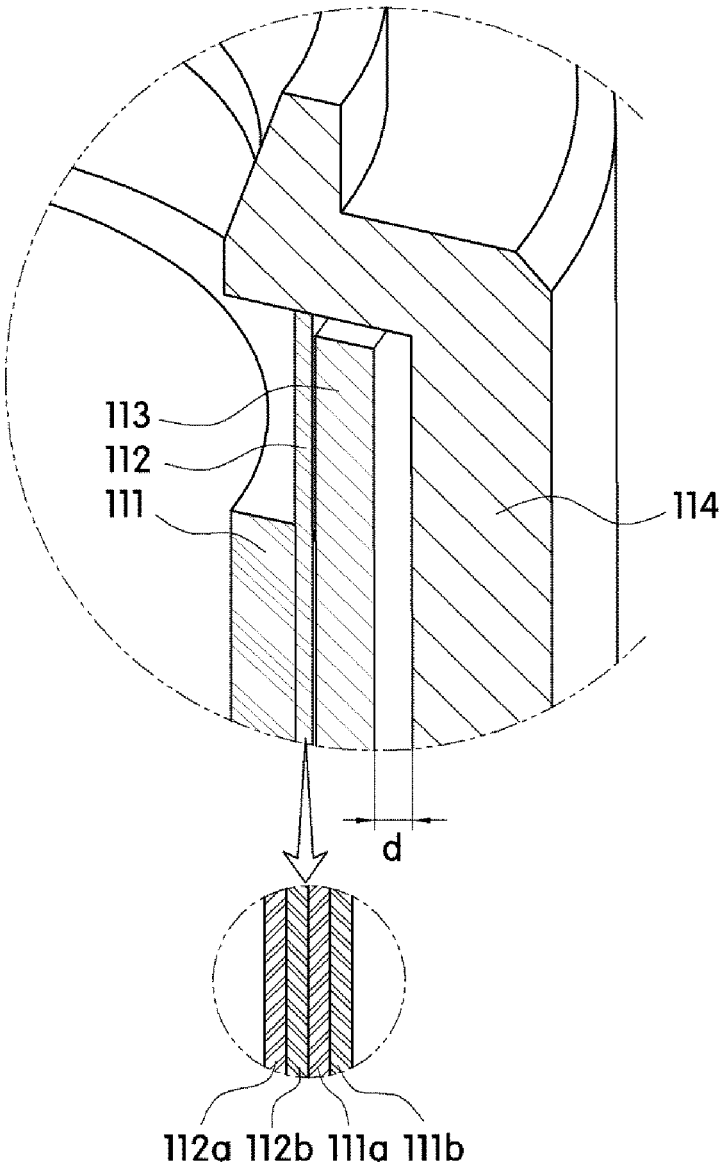
FIG. 6 is an enlarged view of portion "A" of FIG. 5.

In an example, as shown in FIG. 6, the heat insulating member 112 may include a first sheet 112*a* and a second sheet 112*b* which have a certain area and are attached to each other. In this case, any one of the first sheet 112*a* and the second sheet 112*b* may be a plate-shaped graphite sheet, and the other thereof may be a polyimide (PI) film member.

In general, a graphite sheet has a high heat transfer rate in a horizontal direction corresponding to a length or width direction thereof but has a very low heat transfer rate in a vertical direction corresponding to a thickness direction thereof.

In the present invention, the heat insulating member 112 may be disposed outside the first heater 111 in consideration of the above-described heat transfer characteristics of the graphite sheet.

That is, the heat insulating member 112 may have a form in which a plate-shaped graphite sheet and a PI film member are attached to each other. The heat insulating member 112 may be disposed outside the first heater 111 such that a thickness direction of the graphite sheet is parallel to the radial direction of the first heater 111. Accordingly, the heat insulating member 112 may minimize the heat generated in the first heater 111 being dissipated to the outside, thereby concentrating the heat generated in the first heater 111 to the first heater 111.

That is, even when the heat generated in the first heater 111 is transferred to the heat insulating member 112, the heat may be prevented from being dissipated to the outside due to the graphite sheet having a low heat transfer rate in a thickness direction thereof.

In addition, even when a portion of the heat is transferred to the graphite sheet, the heat transferred to the graphite sheet may be dispersed in a horizontal direction so that the graphite sheet may serve to insulate the first heater 111.

Furthermore, a portion of the heat transferred to the graphite sheet may be secondarily blocked from being moved by the PI film member, thereby securing a more excellent heat insulating property.

The heat insulating member 112 may be attached to the outer surface of the first heater 111 through an adhesive layer and may also be fixed through the hollow fixing member 113.

That is, as shown in FIG. 6, the heat insulating member 112 may be wound one or more times to cover the outer surface of the first heater 111 in a circumferential direction of the first heater 111. The heat insulating member 112 may be fixed through the fixing member 113 surrounding the heat insulating member 112.

Accordingly, the heat insulating member 112 may be disposed between the first heater 111 and the fixing member 113, and both surfaces of the heat insulating member 112 may be maintained in a state of being in contact with the outer surface of the first heater 111 and an inner surface of the fixing member 113.

Here, the fixing member 113 may be made of a material having rigidity to perform a function of protecting the first heater 111 as well as a function of fixing the heat insulating member 112 such that the heat insulating member 112 is maintained in a state of being pressed against the outer surface of the first heater 111. In an example, the fixing member 113 may be made of a metal material.

A lower edge of the fixing member 113 may be supported by one side of the supporting part 130.

One side of the first cover member 114 may be coupled to the supporting part 130. As a result, the first cover member 114 may protect the fixing member 113 and the first heater 111 from an external environment and may also maintain mounting positions of the fixing member 113 and the first heater 111.

To this end, the first cover member 114 may be formed to have a hollow form to wrap the fixing member 113, and a region of the first cover member 114 corresponding to the hollow portion of the first heater 111 may be open such that the cigarette 10 inserted from the outside enters into the first heater 111.

A lower portion of the first cover member 114 may be detachably coupled to the supporting part 130. Thus, when the fixing member 113 and/or the first heater 111 require replacement, a component requiring replacement may be easily replaced by separating the first cover member 114 from the supporting part 130.

In this case, in the heater assembly 100 for a cigarette-shaped electronic cigarette according to one exemplary embodiment of the present invention as shown in FIG. 6, a gap d may be formed between an inner surface of the first cover member 114 and an outer surface of the fixing member 113 which face each other. The gap d may be formed in a height direction of the fixing member 113.

Accordingly, an air layer may be formed in the gap d. The air layer formed in the gap d may implement a heat insulating effect. Thus, the heat generated in the first heater 111 may be blocked twice from being transferred in a direction parallel to the radial direction of the first heater 111 through the heat insulating member 112 and the air layer. As a result, the heat generated in the first heater 111 may be further concentrated to the hollow portion of the first heater 111, and a raise in temperature of the first cover member 114 may be minimized.

The smoky vapor generation part 120 may generate smoky vapor not including nicotine during smoking and may supply the smoky vapor to the smoking vapor generation part 110.

Accordingly, during smoking, a user may inhale smoking vapor generated from the cigarette 10 inserted into the smoking vapor generation part 110 and smoky vapor generated in the smoky vapor generation part 120 together.

That is, when a user uses the cigarette-shaped electronic cigarette 200 to which the heater assembly 100 for a cigarette-type electronic cigarette according to one exemplary embodiment of the present invention is applied, the user may additionally inhale and then exhale the smoky vapor not including nicotine generated in the smoky vapor generation part 120 together with the smoking vapor including nicotine generated in the smoking vapor generation part 110.

As a result, the user may inhale and exhale vapor in an abundant amount greater than or equal to an amount of smoke generated during smoking using a typical cigarette, and thus, it is possible to increase satisfaction with smoking.

Figure 8:
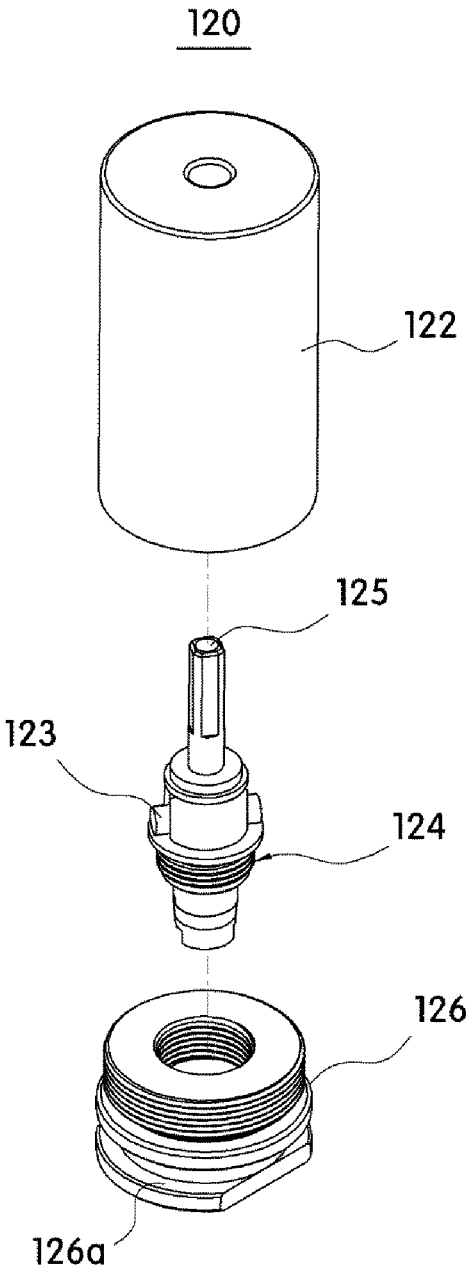
FIG. 8 is a view illustrating a state in which the smoky vapor generation part applicable to the heater assembly for a cigarette-shaped electronic cigarette according to one exemplary embodiment of the present invention is partially exploded.

To this end, as shown in FIGS. 3 and 8, the smoky vapor generation part 120 may include a second cover member 122 which has a storage space 122*a* for storing a liquid material converted into smoky vapor when being heated, and a second heater 121 which vaporizes the liquid material introduced from the storage space 122*a* to generate the smoky vapor. In addition, the smoky vapor generation part 120 may include an absorption member 123 which supplies the liquid material stored in the storage space 122*a* to the second heater 121.

Accordingly, when power is supplied to the second heater 121, the liquid material may be supplied to the second heater 121 through the absorption member 123. The liquid material supplied to the second heater 121 may be vaporized through heat supplied from the second heater 121. As a result, the smoky vapor generation part 120 may generate the smoky vapor.

Here, the liquid material may not include nicotine and may be a material vaporized at a temperature of 100° C. or less. In an example, the liquid material may be a liquid material including glycerin but is not limited thereto. Any liquid material may be applied as long as the material may be vaporized at a temperature of 300° C. or lower, and preferably, at a temperature of 100° C. or less. In addition, the liquid material may also include a nicotine material used to generate smoking vapor in a typical electronic cigarette.

In addition, the absorption member 123 may be a glass fiber, cotton, or a fabric, but the material of the absorption member 123 is not limited thereto. Any material may be applied as long as the material may smoothly absorb a liquid material.

In addition, the second heater 121 may be a coil member wound a plurality of times in a length direction of the absorption member 123.

As shown in FIG. 1, the smoky vapor generation part 120 may be disposed to be parallel with the smoking vapor generation part 110, and smoky vapor generated through the second heater 121 may be supplied to the smoking vapor generation part 110.

To this end, the heater assembly 100 for a cigarette-shaped electronic cigarette according to one exemplary embodiment of the present invention may include the supporting part 130 to which the smoking vapor generation part 110 and the smoky vapor generation part 120 are coupled. The smoking vapor generation part 110 and the smoky vapor generation part 120 may be coupled to one side of the supporting part 130 in parallel.

In this case, the smoky vapor generation part 120 may be provided in a form fixed to the supporting part 130. When the liquid material stored in the storage space 122*a* is completely exhausted, a liquid material may be replenished through an inlet or the like (not shown) communicating with the storage space 122*a*.

Alternatively, as shown in FIG. 2, the smoky vapor generation part 120 may be detachably coupled to the supporting part 130. Thus, when the liquid material stored in the storage space 122*a* is completely exhausted, the smoky vapor generation part 120 itself may be replaced by separating the smoky vapor generation part 120 from the supporting part 130.

Thus, according to the heater assembly 100 for a cigarette-shaped electronic cigarette according to one exemplary embodiment of the present invention, it is possible to eliminate the need to inject a liquid material, and it is possible to increase reliability and stability of a product by inducing a user to use the smoky vapor generation part 120 including a prescribed liquid material.

In a specific example, as shown in FIGS. 2 and 8, the smoky vapor generation part 120 may have a module form which further includes a body 124 and a coupling member 126 in addition to the second cover member 122, the absorption member 123, and the second heater 121.

Thus, the smoky vapor generation part 120 may be detachably coupled to one side of the supporting part 130 through the coupling member 126.

Here, the body 124 may have an air passage 125 formed to pass through the body 124 in a length direction thereof such that outside air passes through the air passage 125. The body 124 may be detachably coupled to the coupling member 126.

In addition, the second cover member 122 may be detachably coupled to the coupling member 126 to surround at least a portion of the body 124. Accordingly, the storage space 122*a* may be defined through the coupling member 126 and the body 124, and an inlet passage 122*b* for introducing outside air may be formed in a height direction of the body 124 so as to be connected to the air passage 125 formed in the body 124 (see FIG. 3).

In addition, the second heater 121 and the absorption member 123 may be disposed in the air passage 125. In this case, the second heater 121 may be disposed in a form which is wound a plurality of times in the length direction of the absorption member 123. The absorption member 123 may be fixed to the body 124 such that both end portions thereof protrude to the storage space 122*a* to smoothly absorb the liquid material stored in the storage space 122*a*.

Furthermore, the coupling member 126 may be formed to have a hollow form such that the body 124 and the second cover member 122 are detachably coupled to an inner surface and an outer surface thereof. A flange 126*a* protruding outward may be formed at a lower edge of the coupling member 126. Thus, the coupling member 126 may be installed to be caught on a latch portion 137 formed to protrude from one surface of the supporting part 130.

In this case, the body 124 may have a form in which a plurality of members are coupled to each other.

In an example, the body 124 may include a first body 124*a*, a second body 124*b*, an insulating member 124*c*, and a first electrode member 124*d*. In this case, the first body 124*a* may be provided in a hollow form of which upper and lower portions are open. The second body 124*b* may be coupled to an upper portion of the first body 124*a*. The insulating member 124*c* to which the first electrode member 124*d* is coupled may be coupled to a lower portion of the first body 124*a*.

As a result, hollow portions of the second body 124*b*, the first body 124*a*, and the first electrode member 124*d* may communicate with each other to form the air passage 125. Both end portions of the absorption member 123 on which the second heater 121 is wound may be fixed to the first body 124*a* when the first body 124*a* and the second body 124*b* are coupled to each other.

In addition, the first body 124*a*, the first electrode member 124*d*, and the coupling member 126 may be made of a conductive material such as a metal, and both end portions of a coil constituting the second heater 121 may connected to the first body 124*a* and the first electrode member 124*d*.

Accordingly, when the smoky vapor generation part 120 is coupled to the supporting part 130, the second heater 121 may be electrically connected through two electrode members 138 and 150 provided in the supporting part 130.

However, the present invention is not limited thereto, and the body may have a form in which an appropriate number of members are coupled to each other or may be one hollow member in which an air passage is formed in a length direction thereof In addition, when the body is formed as one member, the body may have a form in which two through-holes are formed in the body in a direction perpendicular to the air passage 125 and both end portions of the absorption member 123 are inserted into and then fixed in the through-holes.

Furthermore, the configuration of the smoky vapor generation part 120 is not limited to the above-described structure, and the detailed configuration of the smoky vapor generation part 120 may be appropriately modified according to design conditions as long as the smoky vapor generation part 120 may use a method in which the liquid material supplied from the storage space 122*a* is heated through the second heater 121 to generate smoky vapor.

Meanwhile, the supporting part 130 may support the smoking vapor generation part 110 and the smoky vapor generation part 120. As described above, the smoking vapor generation part 110 and the smoky vapor generation part 120 may each be detachably coupled to the supporting part 130.

In this case, the smoking vapor generation part 110 and the smoky vapor generation part 120 may each be coupled onto a horizontal surface of the supporting part 130. However, the smoking vapor generation part 110 and the smoky vapor generation part 120 may be coupled to portions protruding from the horizontal surface by a certain height so as to prevent smoky vapor generated through the second heater 121 from leaking to the outside and to increase coupling performance.

In an example, as shown in FIG. 2, the supporting part 130 may include a first protrusion 131 in a hollow form and a second protrusion 132 in a hollow form which extend upward from one surface thereof by a certain height.

Accordingly, in the smoking vapor generation part 110, a lower portion of the first cover member 114 may be coupled to the first protrusion 131, and a lower edge of the fixing member 113 may be supported by an upper edge of the first protrusion 131.

In addition, in the smoky vapor generation part 120, the second protrusion 132 may be inserted into a lower portion of the coupling member 126. Therefore, the inside of the second protrusion 132 may communicate with the air passage 125.

Figure 9:
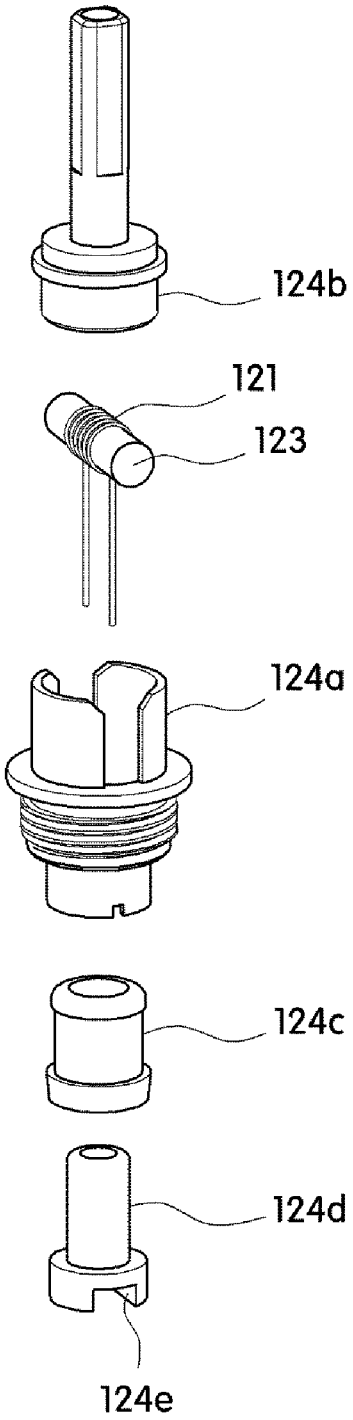
FIG. 9 is an exploded view illustrating a coupling relationship between a body, a second heater, and an absorption member constituting the smoky vapor generation part in the heater assembly for a cigarette-shaped electronic cigarette according to one exemplary embodiment of the present invention.
Figure 10:
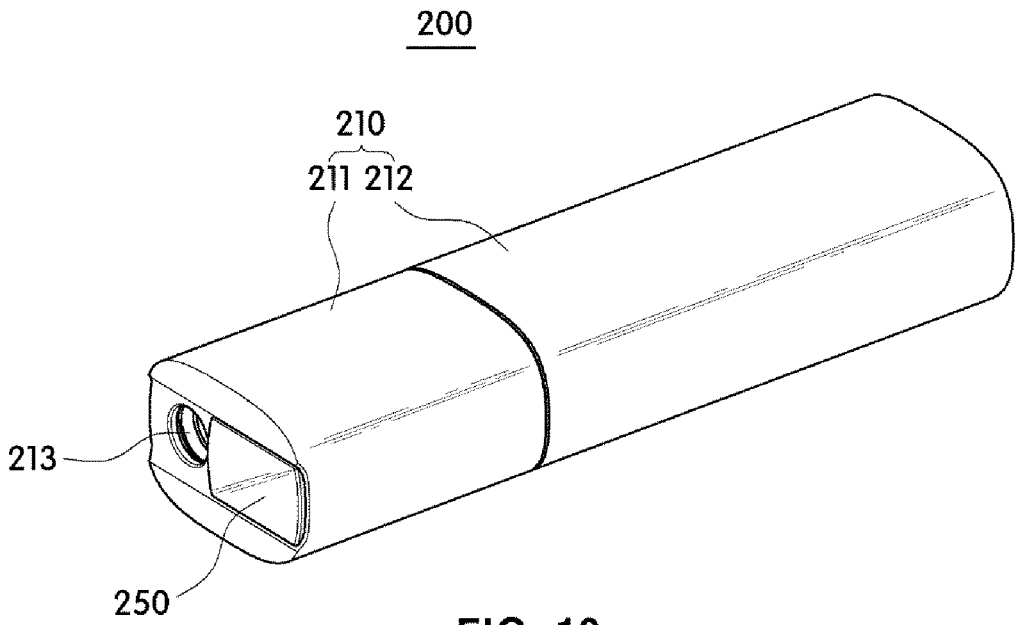
FIG. 10 is a view illustrating a cigarette-shaped electronic cigarette implemented through a heater assembly for a cigarette-type electronic cigarette according to one exemplary embodiment of the present invention.

Here, as shown in FIG. 9, the first electrode member 124*d* may have a cutout groove 124*e* which is recessed from a lower portion to an inner side thereof. Accordingly, air moving in a length direction or height direction of the first electrode member 124*d* may move in a horizontal direction through the cutout groove 124*e* and thus be introduced into the second protrusion 132.

In this case, as shown in FIG. 3, a second electrode member 150 may be provided in the second protrusion 132 in order for an electrical connection with the second heater 121 when the smoky vapor generator 120 and the supporting part 130 are coupled to each other.

In an example, an electrode arrangement hole 136 for placing the second electrode member 150 may be formed to pass through the second protrusion 132, and the second electrode member 150 may be detachably inserted into the electrode arrangement hole 136. Accordingly, when the smoky vapor generation part 120 is coupled to the second protrusion 132, a lower end of the first electrode member 124*d* included in the smoky vapor generation part 120 may be in contact with the second electrode member 150, and the first electrode member 124*d* and the second electrode member 150 may be electrically connected to each other through the contact.

In addition, a contact electrode 138 may be provided on one surface of the supporting part 130 to be externally exposed in a region corresponding to the lower edge of the coupling member 126 when the smoky vapor generation part 120 is coupled to the second protrusion 132.

Accordingly, when the smoky vapor generation part 120 is coupled to the second protrusion 132, the coupling member 126 made of a conductive material and the contact electrode 138 may be in contact with each other. Thus, the coupling member 126 and the contact electrode 138 may be electrically connected to each other. Here, the contact electrode 138 may be a ball plunger, and the second electrode member 150 and the contact electrode 138 may be electrically connected to a main substrate 231 constituting a control part of the cigarette-shaped electronic cigarette 200.

Meanwhile, according to the heater assembly 100 for a cigarette-type electronic cigarette according to one exemplary embodiment of the present invention, when a user puffs on the cigarette 10, smoking vapor generated in the smoking vapor generation part 110 and smoky vapor generated in the smoky vapor generation part 120 may be concurrently supplied to the user. In this case, the smoking vapor and the smoky vapor may be supplied to the user by a suction force of the user.

To this end, the supporting part 130 may include a movement passage 133 through which the smoky vapor generated in the smoky vapor generation part 120 is moved to the smoking vapor generation part 110.

In an example, as shown in FIG. 3, the movement passage 133 may be formed inside the supporting part 130, and the movement passage 133 may connect the inside of the first protrusion 131 and the inside of the second protrusion 132.

In this case, a communication passage 134 may be formed in a bottom surface of the second protrusion 132 and connected to the movement passage 133.

Accordingly, when the user puffs on the cigarette 10 through an end portion thereof inserted into the smoking vapor generation part 110, the smoky vapor generated in the smoky vapor generation part 120 may be moved downward along the air passage 125 by the suction force of the user and then may be moved to a hollow portion of the second protrusion 132 through the cutout groove 124*e* formed in the first electrode member 124*d*.

Thereafter, the smoky vapor moved to the hollow portion of the second protrusion 132 may be introduced into the smoking vapor generation part 110 via the communication passage 134 and the movement passage 133. Thus, the smoky vapor may be combined with the smoking vapor generated in the smoking vapor generation part 110 and may be discharged to the outside together with the smoking vapor through the cigarette.

Accordingly, the user may concurrently inhale the smoking vapor and the smoky vapor. When the user exhales the inhaled vapor to the outside, an amount of the exhaled vapor may be increased by an amount which is as much as an amount corresponding to the smoky vapor. As a result, when the user smokes, an abundant amount of vapor may be discharged to the outside, thereby increasing user satisfaction with smoking.

However, a method of supplying the smoky vapor is not limited thereto, and the smoky vapor generated in the smoky vapor generation part 120 may also be supplied to a path, to which smoking vapor is supplied, through other methods.

In addition, as described above, the inlet passage 122*b*, which is formed in the height direction in the smoky vapor generation part 120 such that outside air is introduced therethrough, may be connected to the air passage 125. Thus, the smoky vapor generated in the smoky vapor generation part 120 may be smoothly moved to the smoking vapor generation part 110 through the movement passage 133 by the suction force of the user.

Meanwhile, the circuit board 140 electrically connected to the first heater 111 may be disposed on one surface of the supporting part 130. The circuit board 140 may be fixed to the supporting part 130.

In an example, as shown in FIG. 3, the supporting part 130 may include an accommodation groove 139 formed to be recessed from one surface thereof to accommodate the circuit board 140, and the circuit board 140 may be fitted into and disposed in the accommodation groove 139.

Here, the plurality of lead portions 111*d* protruding from the first heater 111 to have a certain length may be connected to the circuit board 140. The circuit board 140 may be electrically connected to the main substrate 231 constituting the control part of the cigarette-shaped electronic cigarette 200 through a separate case (not shown).

In addition, lead portion arrangement holes 135 through which the plurality of lead portions 111*d* pass may be formed to pass through the supporting part 130. Accordingly, the lead portions 111*d* inserted into the lead portion arrangement holes 135 may be protected from an external force through the supporting part 130.

Thus, when the first heater 111 is electrically connected to the circuit board 140 fixed to one surface of the supporting part 130 through the lead portions 111*d* passing through the lead portion arrangement holes 135, even when an external impact occurs due to a drop, the lead portions 111*d* may be prevented from being disconnected from the circuit board 140. As a result, various problems such as electrical disconnection may be solved, and reliability of a product may be improved.

The heater assembly 100 for a cigarette-shaped electronic cigarette may be implemented into the cigarette-shaped electronic cigarette 200.

As shown in FIGS. 10 to 13, the cigarette-shaped electronic cigarette 200 according to one exemplary embodiment of the present invention may include the heater assembly 100 for a cigarette-shaped electronic cigarette, a case 210, the control part, and a power supply part 220.

That is, the heater assembly 100 may be accommodated inside the case 210 together with the control part and the power supply part 220 and may use power provided from the power supply part 220 as driving power. That is, in the heater assembly 100, the first heater 111 and the second heater 121 may be operated by driving of the control part, and smoking vapor and smoky vapor may be generated from the cigarette inserted into the smoking vapor generation part 110 and the liquid material included in the smoky vapor generation part 120, respectively.

Figure 12:
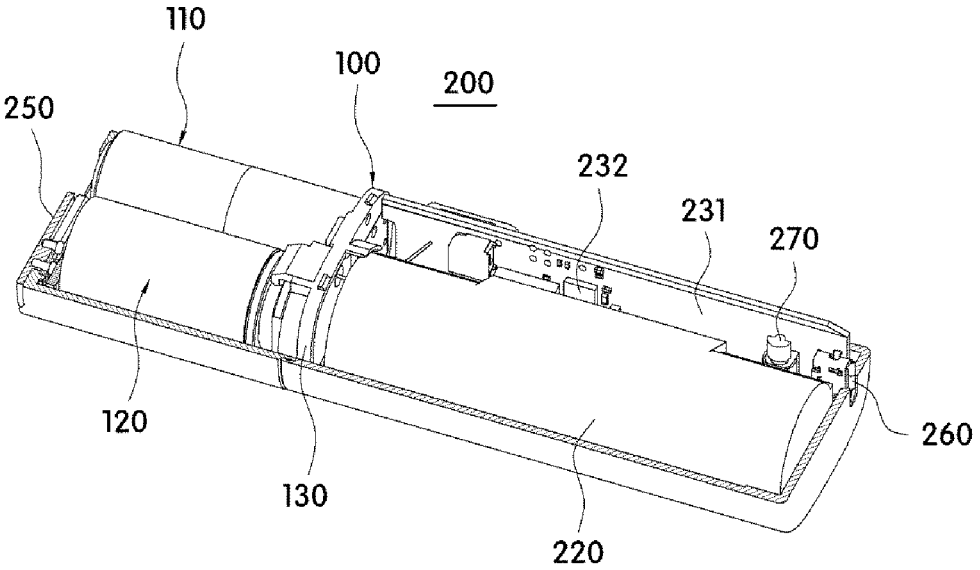
FIG. 12 is a cut-away view of a portion of a case in FIG. 10.

Here, the power supply part 220 may be a known battery, and the battery may be a primary battery or may be a rechargeable secondary battery. In addition, as shown in FIG. 12, the control part may have a form in which a chipset 232 such as a main control unit (MCU) is mounted on one surface of the main substrate 231, and the main substrate 231 may include various circuits for electrical or electronic driving.

Specifically, the case 210 may include a first case 211 configured to accommodate the smoking vapor generation part 110 and the smoky vapor generation part 120 therein and a second case 212 configured to accommodate the control part and the power supply part 220 therein. In addition, the supporting part 130 may be detachably fixed to an upper edge of the second case 212.

Figure 11:
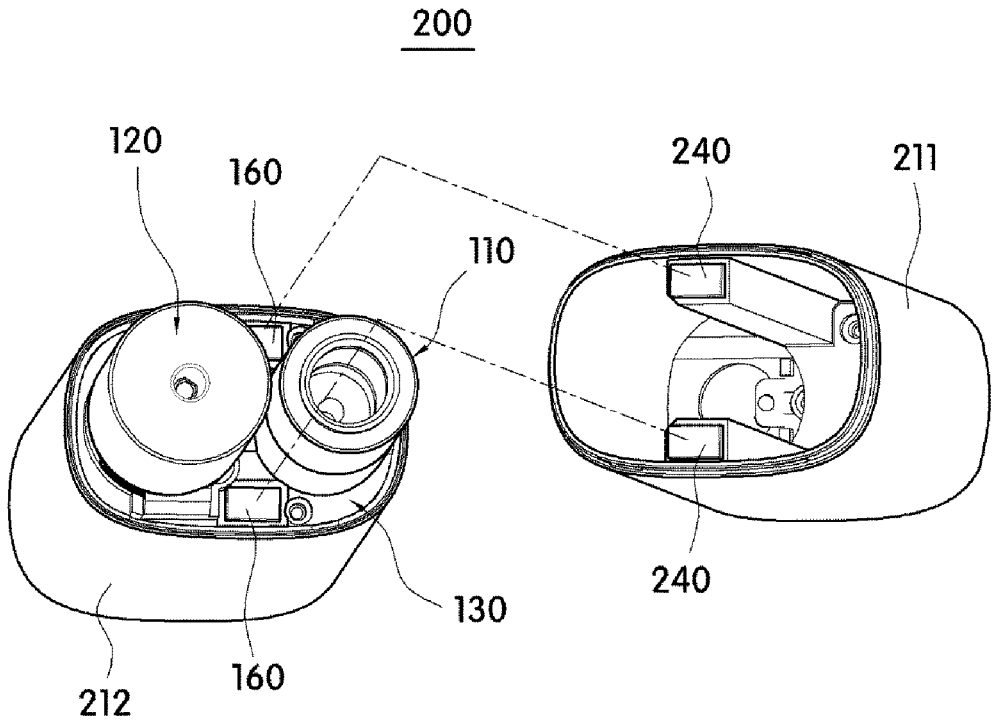
FIG. 11 is a view illustrating a state in which a first case is separated from a second case in FIG. 1.

In this case, as shown in FIG. 11, a pair of magnet members 160 and 240 corresponding to each other may be provided in the first case 211 and the supporting part 130. Accordingly, the pair of magnet members 160 and 240 may provide a binding force caused by a magnetic force, and the first case 211 may be prevented from being easily separated from the second case 212 through the binding force. However, the shape of the case 210 is not limited thereto, and the case 210 may be formed as one member.

In this case, the first case 211 may include an inlet 213 formed to pass through a region corresponding to the smoking vapor generation part 110.

Accordingly, when the cigarette 10 is inserted into the inlet 213, the cigarette 10 may be inserted into the hollow portion of the first heater 111 formed to have a hollow form and may be heated by heat generated in the first heater 111.

On the other hand, the case 210 may further include a cover member 250 for opening or closing the inlet 213. Thus, when the cigarette-shaped electronic cigarette 200 is not in use, the cover member 250 may close the open inlet 213 to prevent the first heater 111 from being externally exposed. Accordingly, the first heater 111 may be prevented from being contaminated from an external environment.

Figure 13:
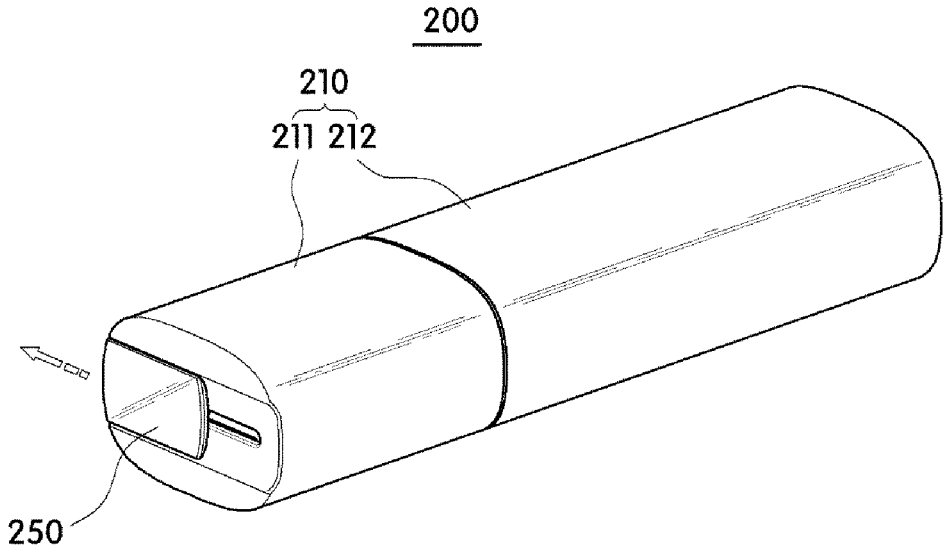
FIG. 13 is a view illustrating a state in which an inlet is sealed through movement of a cover member in FIG. 10.

In an example, as shown in FIG. 13, the cover member 250 may be implemented in a sliding manner in which the cover member 250 reciprocates along one surface of the case 210, but the present invention is not limited thereto. All various known manners such as a hinge manner and an insertion manner may be applied as long as the cover member 250 may have a form which seals the inlet 213.

In addition, as shown in FIG. 12, a charging port 260 for recharging the power supply part 220 may be externally exposed from one side of the case 210. The charging port 260 may be mounted on the main substrate 231.

For example, the charging port 260 may be a known Universal Serial Bus (USB) connector, and a known charging cable may be connected thereto. Thus, when the power supply part 220 needs to be charged, the charging port 260 may be connected to an external power supply source through a charging cable to receive power, and thus, the power supply part 220 may be recharged.

In addition, the cigarette-shaped electronic cigarette 200 may include a notification part which outputs a certain signal such that a user recognizes a variety of information such as turn-on/off, an operating time of the first and second heaters 111 and 121, and a smokable state or a non-smokable state.

In an example, as shown in FIG. 12, the notification part may be a vibration motor 270 which is electrically connected to the control part to generate a vibration when a notification is required.

However, the present invention is not limited thereto, and the notification part may use a method of outputting a sound, a method of displaying a text, a method of turning on/off a light, or a method in which two or more methods are combined with each other.

In addition, the cigarette-shaped electronic cigarette 200 may have a wireless communication function of transmitting and receiving information related to a state of a device or smoking such as the number of instances of inhalations to and from an external device through wireless communication. For example, the wireless communication function may use a Bluetooth or near field communication (NFC) method, but the present invention is not limited thereto. All of various known wireless communication methods may be applied.

While the exemplary embodiments of the present invention have been described above, the present invention is not limited to the embodiment presented herein. One skilled in the art may easily suggest other embodiments due to addition, modification, deletion, and the like of components within the scope and spirit of the present invention, and the addition, modification, deletion, and the like of the components fall within the scope and spirit of the present invention.

The invention claimed is:

1. A heater assembly for a cigarette-shaped electronic cigarette, the heater assembly comprising:

a smoking vapor generation part including a first heater configured to generate smoking vapor by heating a portion of a cigarette inserted thereinto;

a smoky vapor generation part including a second heater configured to generate smoky vapor by heating a liquid material when the cigarette is puffed on; and a supporting part to which each of the smoking vapor generation part and the smoky vapor generation part is coupled, wherein the supporting part includes a movement passage through which the smoky vapor generated in the smoky vapor generation part is moved to the smoking vapor generation part, wherein the smoky vapor passes through the cigarette by a suction force generated when the cigarette is puffed on and then is inhaled concurrently with the smoking vapor, and wherein the smoking vapor generation part includes:

the first heater;

a heat insulating member wound one or more times to surround an outer surface of the first heater in a circumferential direction of the first heater;

a fixing member formed to have a hollow form to surround the heat insulating member and configured to surround and fix the heat insulating member such that the heat insulating member is maintained in a state of being pressed against the outer surface of the first heater;

a first cover member disposed outside the fixing member; and a gap is formed between an inner surface of the first cover member and an outer surface of the fixing member, which face each other, in a height direction of the fixing member.

2. The heater assembly of claim 1, wherein the supporting part includes a protrusion in a hollow form which protrudes in one direction and to which the smoky vapor generation part is coupled, and a communication passage is formed in a bottom surface of the protrusion and connected to the movement passage.

3. The heater assembly of claim 1, wherein the smoky vapor generation part is detachably coupled to the supporting part.

4. The heater assembly of claim 1, wherein an accommodation groove is formed in one surface of the supporting part to accommodate a circuit board, and the circuit board is electrically connected to the first heater.

5. The heater assembly of claim 1, wherein the first heater is formed to have a hollow cylindrical shape of which upper and lower portions are open such that the portion of the cigarette is inserted thereinto, and the first heater heats an outer surface of the cigarette.

6. The heater assembly of claim 5, wherein the first heater includes:

a support made of a ceramic material and formed to have a hollow form;

an electrode pattern patterned on one surface of the support to generate heat; and a protective layer having an insulating property and a heat insulating property and covering the electrode pattern.

7. The heater assembly of claim 1, wherein the heat insulating member includes a graphite material to reduce heat generated in the first heater from being dissipated in a radial direction of the first heater.

8. The heater assembly of claim 1, wherein the smoky vapor generation part includes:

a body having an air passage formed in a length direction thereof such that outside air passes through the air passage;

a coupling member coupled to the body;

a second cover member coupled to the coupling member to form a storage space in which the liquid material is accommodated in a certain amount;

an absorption member disposed in the air passage to absorb the liquid material introduced from the storage space; and a second heater wound a plurality of times in a length direction of the absorption member to generate the smoky vapor by vaporizing the liquid material absorbed by the absorption member when power is applied.

9. A cigarette-shaped electronic cigarette comprising:

the heater assembly of claim 1;

a case which has an inlet for inserting the cigarette in a region corresponding to the smoking vapor generation part and in which the heater assembly is embedded;

a control part disposed inside the case to control an overall operation of the heater assembly; and a power supply part configured to supply driving power to the control part.

10. The cigarette-shaped electronic cigarette of claim 9, wherein the case includes a cover member configured to open or close the inlet.

11. The cigarette-shaped electronic cigarette of claim 9, wherein a charging port configured to recharge power of the power supply part is provided at one side of the case.

* * * * *